US006496587B1

(12) United States Patent
Mueller

(10) Patent No.: US 6,496,587 B1
(45) Date of Patent: Dec. 17, 2002

(54) HEARING AID

(75) Inventor: Josef Mueller, Feusisberg (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/504,322

(22) Filed: Feb. 14, 2000

(30) Foreign Application Priority Data

Feb. 9, 2000 (WO) ..... PCT/CH00/00071

(51) Int. Cl.[7] ..... H04R 25/00
(52) U.S. Cl. ..... 381/330; 381/359
(58) Field of Search ..... 381/330, 322, 381/327, 359; 181/129, 132, 137

(56) References Cited

U.S. PATENT DOCUMENTS 4,564,955 A * 1/1986 Birch et al. ..... 381/322

FOREIGN PATENT DOCUMENTS

DE 42 30 308 C1 5/1993
EP 0 847 227 A2 6/1998

OTHER PUBLICATIONS

Patent Abstracts of Japan, vol. 1997, No. 01,31. Publication No. 08251698, Sep. 27, 1996, 1 page.

* cited by examiner

*Primary Examiner*—Sinh Tran
(74) *Attorney, Agent, or Firm*—Pearne & Gordon LLP

(57) ABSTRACT

A hearing aid comprising a case (1) and a horn (2) connectable to the case. The hearing aid also includes an acoustic input aperture and an acoustic output aperture (4). The horn (2) is rotatably supported in the case (1), and a detachable lid (3) is released by rotating the horn (2) from an operational hearing-aid position into a servicing position. In this manner, the lid (3) is simply removed from and/or inserted into the horn. The lid covers as well as forms the acoustic input aperture.

17 Claims, 2 Drawing Sheets

HEARING AID

BACKGROUND OF THE INVENTION

A person wears a hearing aid to improve his/her impaired hearing. Acoustic signals from the environment are received through an input aperture in the hearing-aid case into the hearing aid proper, wherein the signals are processed according to the said impairment. The processed signal is then fed through a so-called acoustic duct and through an output aperture into the inner ear. Such hearing aids, when used daily, will soil and the soiling will partly affect the acoustic behavior of the elements of acoustic-wave carriers. As a result of the change in the acoustic behavior, the actual function of the hearing aid can be implemented only in a restricted way.

Accordingly, proposals have been advanced to fit the acoustic input and output apertures with a protective element to prevent soiling penetration. Reference is made in this regard to the European patent document 0,847,227 A. When the protective elements are soiled to some extent, they must be replaced by new ones to restore the hearing-aid function to its optimal condition.

However, as regards the known hearing aids, exchanging the protective elements is fairly laborious and complex. Frequently, substantial hearing-aid parts, such as a full horn, must be replaced because the lids are bonded to this horn.

Therefore, there exists a need in the art for a hearing aid that has simple and reliably replaceable protective elements.

SUMMARY OF THE INVENTION

The present invention is directed toward a hearing aid that allows simple and reliable exchange of protective elements.

The present invention offers several advantages. The horn is rotatably supported inside the hearing-aid case. The lid is freed, by rotating the horn from a hearing-aid operational position into a hearing-aid servicing position. The lid, which covers and forms an acoustic input aperture, can be exchanged in a simple and rapid manner. Advantageously, the lid is in the shape of a wedge, partly interrupted by a guide slot, and preferably is made of an open-pore material.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
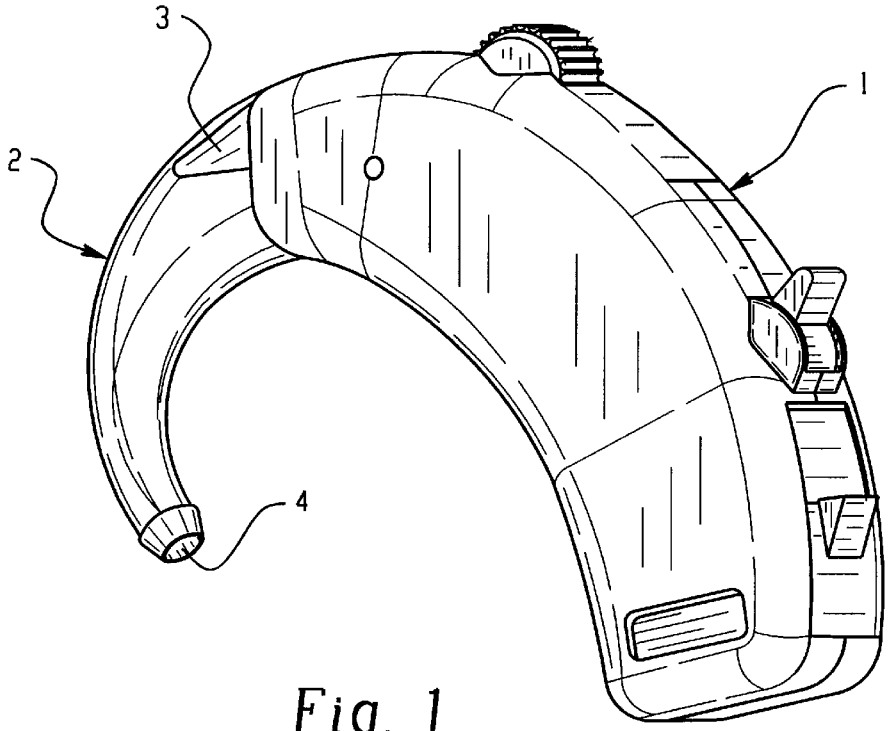
FIG. 1 shows a hearing aid, including a case and a horn, in an operational position.

FIG. 1 shows a hearing aid substantially consisting of a case 1 and a horn 2. The hearing aid is illustrated in a so-called operational position, wherein it can be set on a patient's ear. In addition to various operating elements such as an ON/OFF switch, volume control etc, the case 1 also comprises two acoustic transmission apertures (not visible in FIG. 1) in the coupling zone to the horn 2. One of these apertures transmits acoustic signals from the ambience to the inside of the case 1 and to an acoustic transducer or to an electric signal processing unit. The electric signals processed in the processing unit are converted, again in an electroacoustic transducer, into acoustic signals which then are transmitted through the second aperture into an acoustic duct 5 (FIG. 3) inside the horn 2 to an acoustic output aperture 4. As regards a hearing aid set on a patient's ear, acoustic waves issuing from the acoustic output aperture a re directly fed into the patient's auricular canal.

The acoustic input aperture transmitting the ambient acoustic waves inside the hearing aid is covered by a lid 3. The lid 3 is preferably configured as a three-dimensional body of which the outside runs, on one hand, flush with the outer shape of the case 1 and, on the other hand, flush with the outer shape of horn 2. Moreover, the lid 3 is made of an open-pore material. Materials especially well suited for the lid 2 are found in the European patent document 0,847,227.

Figure 2:
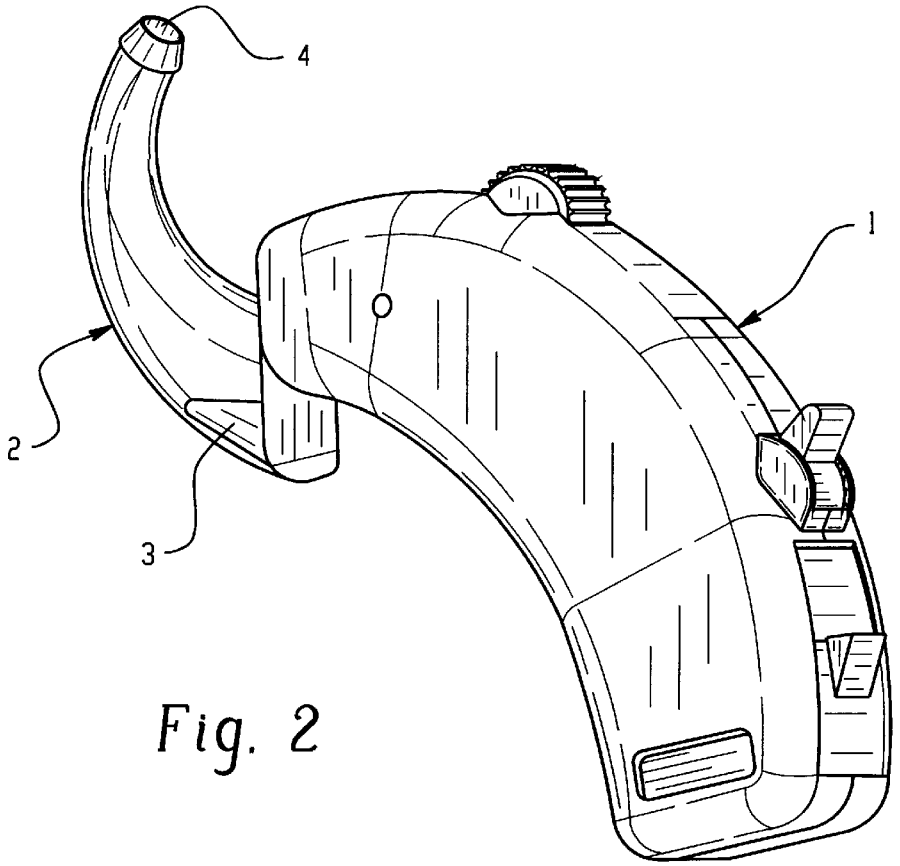
FIG. 2 shows the hearing aid of FIG. 1 in a servicing position.

FIG. 2 illustrates the hearing aid of FIG. 1 in the servicing position wherein the lid 3 has been removed from or inserted into a recess in the horn 3. For such an operation, the horn 2 is rotated 180° relative to the case 1 and, as a result, the lid 3 can be displaced out of the recess toward the case 1. The lid 3 and the corresponding recess in the horn 2 are configured such that, on one hand, the lid 3 can be moved along and next to the case 1. On the other hand, the lid 3 is wedge-shaped both in the direction of insertion and transversely to the direction of insertion. Due to the shape of the lid, the lid is automatically centered during insertion into the recess.

In the preferred embodiment of the hearing aid of the invention, the horn 2 is rotatably supported in the case 1. The axis of horn rotation preferably coincides with the center axis of the acoustic duct in the zone of coupling between the case 1 and the horn 2.

Figure 3:
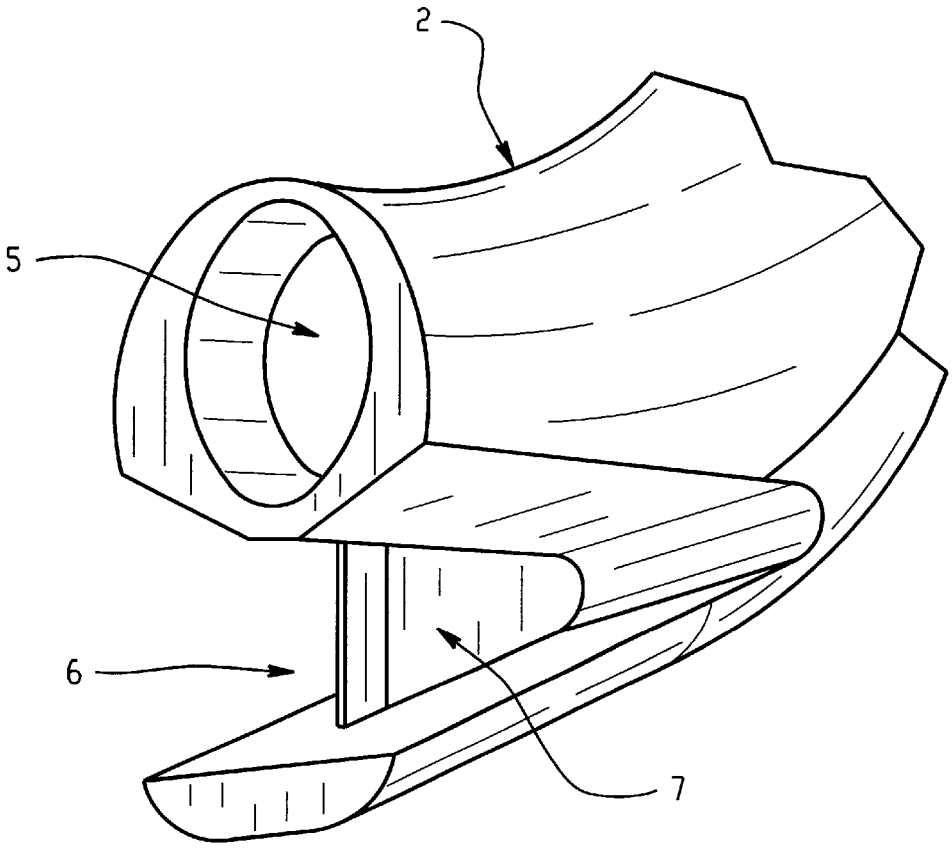
FIG. 3 shows the horn without the lid.

FIG. 3 shows a detail of the horn 2, as a sideview of the coupling site between the housing 1 (FIGS. 1, 2) and the horn 2. The aperture 6 in the horn 2 receiving the lid 3 (FIGS. 1, 2) is devoid of the lid. The acoustic transmission aperture into the acoustic duct 5 is well visible. The horn is rotatable relative to the housing 1 (FIGS. 1, 2) about the center axis of the aperture. In a preferred embodiment, the recess 7 is fitted with a guide bracket 7 additionally affixing or centering the lid 4.

Figure 4:
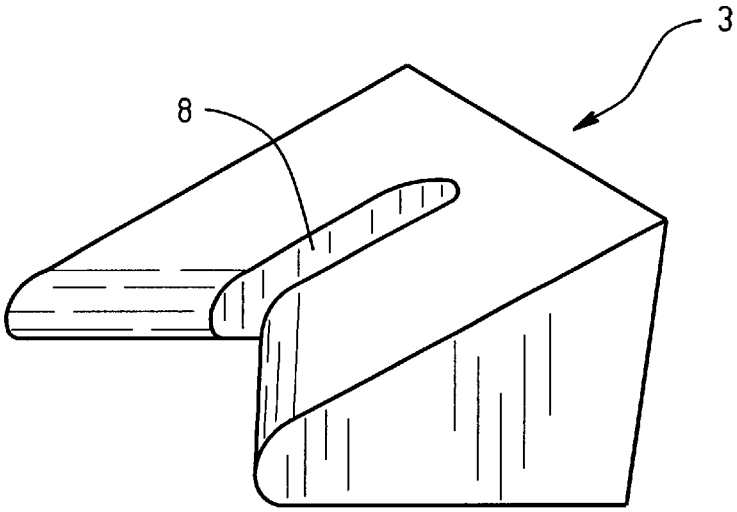
FIG. 4 shows the lid.

Lastly, FIG. 4 shows the lid 3 fitted to the recess 7 of FIG. 3. FIG. 4 clearly shows the wedge shape of the lid and a guide slot 8, which is engaged by the guide bracket 7 of FIG. 3, to fully stabilize the lid 3.

What is claimed is:

1. A hearing aid comprising a case (1) and horn (2) said horn being adapted to be removably connected to said case, said hearing aid further comprising an acoustic input aperture and an acoustic output aperture (4) wherein the horn (2) is rotatably supported in the case (1), said hearing aid further comprising a detachable lid (3), said lid (3) both covering and constituting an acoustic intake aperture, said lid being released from a remaining assembly of said case (1) and horn (2) by rotation of said horn (2) from an operational position of said hearing aid into a servicing position of said hearing aid.

2. The hearing aid as claimed in claim 1, wherein the lid (3) is disposed in the horn (1).

3. The hearing aid as claimed in claim 1, wherein the horn (2) is rotatable about a longitudinal axis of an acoustic duct (5) leading to the acoustic output aperture (4).

4. The hearing aid as claimed in claim 1, wherein the lid is disposed in a recess (6) and surfaces of the lid are snugly received and seated in said recess (6).

5. The hearing aid as claimed in claim 4, wherein the lid (3) is designed as a three-dimensional solid.

6. The hearing aid as claimed in claim 5, wherein the lid (3) is wedge-shaped.

7. The hearing aid as claimed in claim 4, further comprising a guide element (7) through which the lid (3) is displaceably guided into the recess (6).

8. The hearing aid as claimed in claim 1, wherein the lid (3) also serves as a wind protector.

9. The hearing aid as claimed in claim 1, wherein the lid (3) is made of an open-pore material.

10. A hearing aid comprising a case (1) and horn (2), said horn (2) being adapted to be removably connected to said case (1), said horn (2) being rotatably supported in said case (1), said hearing aid further comprising an acoustic input aperture and an acoustic output aperture (4), and comprising a detachable lid (3), said lid (3) both covering the acoustic input aperture and constituting an acoustic intake aperture, said horn (2) being rotated from an operational position of said hearing aid into a servicing position of said hearing aid in order to release said lid (3) from said case (1) and said horn (2).

11. The hearing aid as set forth in claim 10, wherein said case (1) and said horn (2) remain together during release of said lid (3) from said case (1) and said horn (2).

12. The hearing aid as set forth in claim 10, wherein upon release of said lid (3) from said case (1) and said horn (2), said lid (3) is removable from said case (1) and said horn (2).

13. The hearing aid as set forth in claim 12, wherein said lid (3) is mounted on said horn (2), and said case (1) has a portion that blocks removal of said lid (3) when said horn (2) is in the operational position, and unblocks removal of said lid (3) when said horn (2) is in the servicing position.

14. The hearing aid as set forth in claim 13, wherein said lid (3) is configured to slide from said horn (2) when the portion of said case (1) unblocks removal of the lid (3) in the servicing position.

15. The hearing aid as set forth in claim 10, wherein the action of rotating said horn (2) from the operational position to the servicing position causes the release of said lid (3).

16. The hearing aid as set forth in claim 15, wherein upon release of said lid (3) from said case (1) and said horn (2), said lid (3) is removable from said case (1) and said horn (2).

17. The hearing aid as set forth in claim 15, wherein said lid (3) is not readily removable from said case (1) and said horn (2) when said horn (2) is in the operational position of said hearing aid.

* * * * *